United States Patent [19]

Haley

[11] Patent Number: 4,649,694

[45] Date of Patent: Mar. 17, 1987

[54] ENVELOPE CONTENTS EXTRACTION SYSTEM

[75] Inventor: Paul E. Haley, Hammonton, N.J.

[73] Assignee: Opex Corporation, Cherry Hill, N.J.

[21] Appl. No.: 587,986

[22] Filed: Mar. 9, 1984

[51] Int. Cl.[4] ..... B65B 43/30

[52] U.S. Cl. ..... 53/381 R; 83/912; 414/412

[58] Field of Search ..... 414/412; 53/381 R, 384; 83/408, 912

[56] References Cited

U.S. PATENT DOCUMENTS

| | | | |
|---|---|---|---|
| 3,238,926 | 3/1966 | Huck | 53/381 R |
| 3,476,043 | 11/1969 | Erdley | 83/912 |
| 3,884,010 | 5/1975 | Bardo et al. | 53/381 R X |
| 4,016,708 | 4/1977 | DeHart | 53/381 R |
| 4,124,968 | 1/1978 | Stevens et al. | 53/381 R |
| 4,333,300 | 6/1982 | Russell | 414/412 X |

*Primary Examiner*—Joseph E. Valenza
*Assistant Examiner*—David A. Bucci
*Attorney, Agent, or Firm*—Weiser & Stapler

[57] ABSTRACT

An envelope contents extraction system in which adjacent edges of an envelope are opened to make the contents of the envelope accessible from two edges. The stations at which the envelope edges are opened and the contents removed are located along a single straight-line path. The envelopes are delivered to these stations by a straight-line conveyor which receives the envelopes and moves in one direction to move the envelopes to a side edge cutter and then in the opposite direction to move the envelope to a top edge cutter and an envelope spreader.

10 Claims, 6 Drawing Figures

ENVELOPE CONTENTS EXTRACTION SYSTEM

DESCRIPTION

1. Technical Field

The present invention relates, in general, to the handling of mail and, in particular, to machinery for partially automating the extraction of contents of envelopes.

2. Background Art

Machinery for extracting the contents of envelopes is useful when a large volume of mail is received by business establishments and the envelopes containing items, such as checks, bill stubs, order forms and the like, must be emptied in a relatively short period of time. Banks, insurance companies, mail order houses, and various other businesses which serve both industry and the retail markets are among the many different users of such equipment. Also, other recipients of large volumes of mail, such as government agencies and charitable organizations, are potential users of machines which facilitate removing the contents of envelopes.

It is, of course, technoligically possible to perform such extraction of the contents of envelopes in a fully automated way, meaning that the envelopes are opened and emptied, all without human intervention. However, because it is usually desirable to perform sorting operations on the envelope contents, it has actually proven more desirable, in many instances, to have the actual extraction step performed by hand, through a human operator, rather than by machine. On the other hand, the preparatory steps, including opening the envelopes, transporting them to the operator's location, and spreading them to facilitate manual extraction of the contents, as well as the follow-on step of envelope disposal are preferably performed automatically, with a minimum of operator action, if any.

A number of machines have been proposed for performing the partially automated task of extracting the contents of envelopes, and some of these are commercially available. Typically, in such machines, a batch of envelopes is placed in a hopper from which they are picked, one at a time, by a reciprocating suction cup mechanism. Each so-picked envelope is then deposited on a conveyor, where it is first sliced open automatically along one long edge and then transported to the point where the operator is located. There, the envelope is stopped and its front and back faces are drawn apart by suction cups which engage these faces from opposite sides of the envelope. This enables the operator to conveniently reach into the envelope and extract its contents. Thereafter, the envelope is released and transported further along the path of the conveyor for ultimate discarding.

Various refinements have been proposed and incorporated in this type of machine. For example, means have been provided for automatically detecting the act of extracting the envelope contents and in response thereto cycling the machine to handle the next envelope. Means have also been provided for "candling" the supposedly empty envelopes, after they leave the extraction station, to prevent the discarding of contents which have inadvertently been left in the envelope.

Certain envelope contents extraction machines have been provided with means for opening the envelope, not only along one edge, but also along one or both adjacent edges, so that the subsequent drawing-apart operation, in effect, makes the contents accessible from two or more edges of the envelope. Generally, the prior art envelope extraction machines which have multi-edge openers are arranged to move the envelopes through the machines along two or more non-parallel directions or manipulate the envelopes to change their orientations as they are moved through the machine. This requires complex mechanisms for transporting and transferring the envelopes. For example, in machines which use cutters which are disposed parallel to the envelope edges which they cut and parallel to the direction of movement of the envelope through the cutter, the orientation of the envelopes is changed as the envelopes move from one edge cutter to the next one which cuts an adjacent perpendicular edge. The complexity of the envelope transport and transfer mechanisms in such machines adds cost to the machines and affects their reliability.

DISCLOSURE OF INVENTION

Accordingly, it is an object of the present invention to provide a new and improved machine for the partially automated extraction of envelope contents.

It is another object of the present invention to provide such a machine which opens envelopes along two adjacent edges.

It is a further object of the present invention to provide such a machine which is particularly convenient to operate and maintain and provides reliable operation.

These and other objects are achieved by an envelope contents extraction system constructed in accordance with the present invention which has means for supplying a plurality of envelopes one-by-one and means for transporting individual envelopes along a single straight-line path to a plurality of stations. A first edge of each envelope is opened while this edge is disposed perpendicular to the path of movement and an adjacent second edge is opened while the second edge is disposed along the path of movement. The system also includes means for separating the front and back faces of the envelopes after the edges have been opened so that the envelope contents may be extracted and means for controlling movement of the transporting means to move the envelopes along the path of movement.

BEST MODE OF CARRYING OUT THE INVENTION

Figure 1:
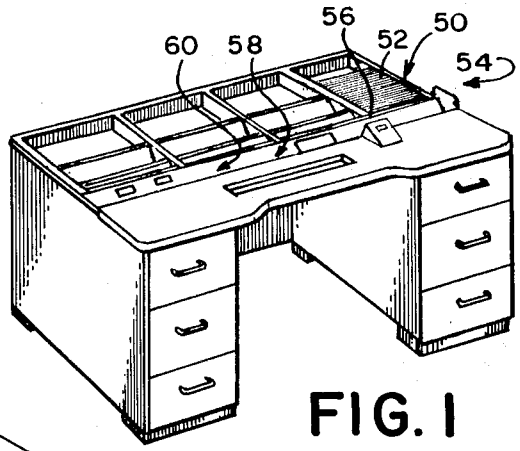
FIGS. 1 and 1*a* are perspective views of a desk in which an envelope contents extraction system, constructed in accordance with the present invention, is housed.
Figure 1A:
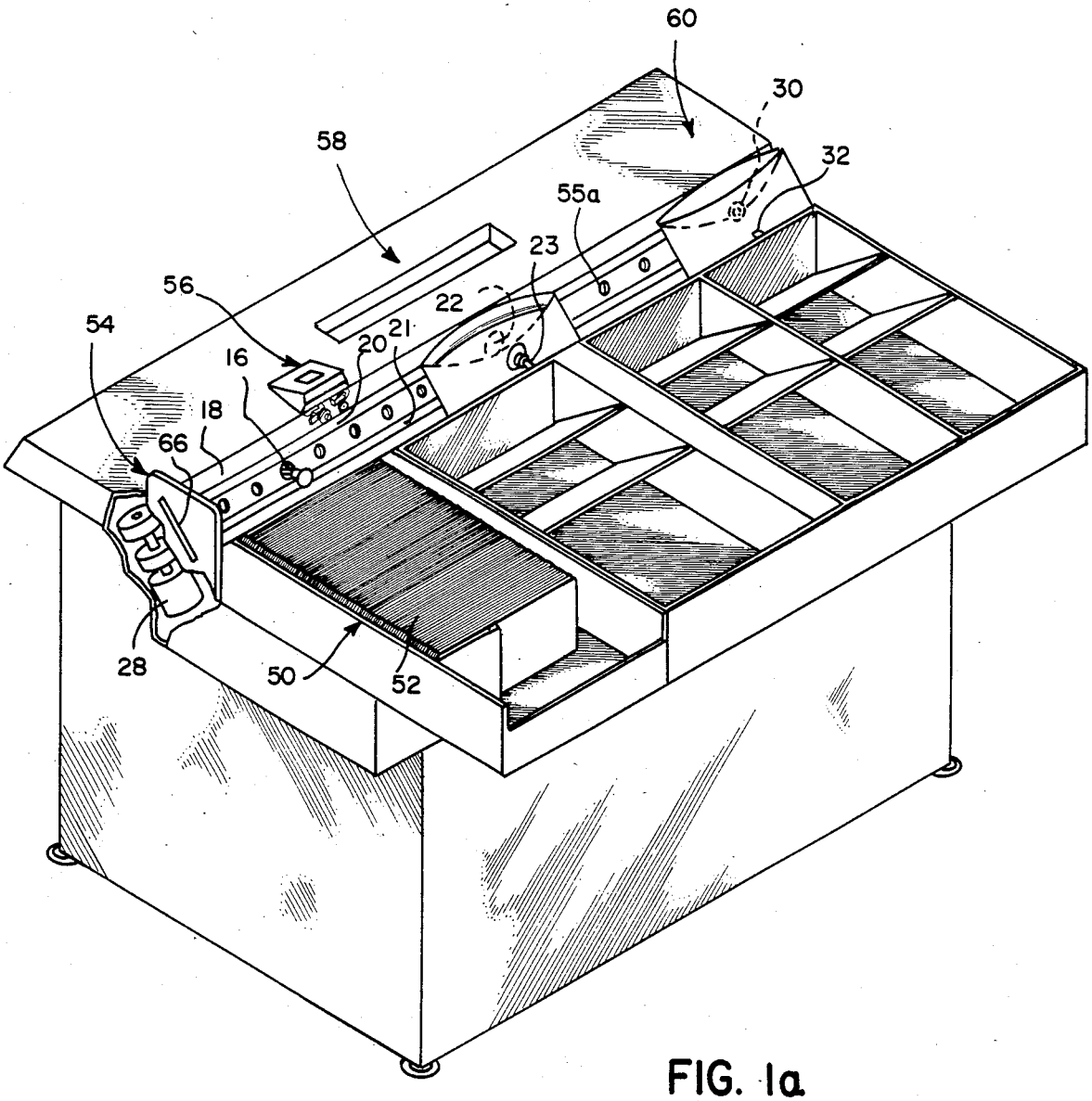

Referring to FIGS. 1 and 1*a*, there is shown a desk within which an envelope contents extraction system, constructed in accordance with the present invention, is housed. This system includes a feed tray 50 in which a plurality of envelopes 52 are stored and which are delivered one-by-one to a plurality of stations at which different operations are performed on the envelopes. These operations include opening a side edge of each envelope at station 54, opening a long edge of each envelope at station 56, separating the front and back faces of each envelope at station 58 so that the contents of the envelope may be removed, and determining that all of the contents of the envelope have been removed at station 60. It will be understood that references to side edges and long edges of the envelopes are only for the purpose of facilitating an explanation of the invention and that the present invention is applicable to handling square envelopes. However, because rectangular envelopes are most common, particularly when dealing with mail of the type received by potential users of the present invention, the edges of the envelopes will be referred to as side edges, long edges, top edges and bottom edges.

An envelope contents extraction system, constructed in accordance with the present invention, also includes means for transporting individual envelopes along a single straight-line path to the different stations and means for controlling movement of the transporting means to move the envelopes along the path of movement, so that the envelopes are delivered to the different stations and the desired operations are performed on the envelopes. This may be accomplished by an envelope transport mechanism such as the one described and illustrated in U.S. Pat. No. 4,124,968, and the disclosure of this mechanism in U.S. Pat. No. 4,124,968 is incorporated by reference herein as if fully set forth.

In the present invention, two adjacent edges of an envelope are opened by means of edge cutters which act along the lines of the edges they cut. The side edge cutter is disposed transversly to open a side edge of the envelope and the top edge cutter is disposed longitudinally to open the top edge of the envelope. This may be accomplished by a conventional reversing motor 28 which drives the envelope transport mechanism first in one direction to move each envelope to the side edge cutter to cut what becomes the trailing edge relative to subsequent movement of the envelope and then moving the envelope in an opposite direction to the top edge cutter.

Envelopes 52, stacked in feed tray 50 on their bottom edges, are supplied one-by-one from the feed tray by suitable means, such as suction cup 16 in U.S. Pat. No. 4,124,968. Again, the disclosure in U.S. Pat. No. 4,124,968 of this portion of the apparatus is incorporated by reference herein as if fully set forth.

Each envelope is positioned against a suitable conveyor, such as belts 20 and 21 in U.S. Pat. No. 4,124,968, and held in place against the conveyor by suitable means, such as suction holes 55*a* in a sloping shelf 18, in U.S. Pat. No. 4,124,968. With such an arrangement, the envelopes are transported through the machine on an angle corresponding to the sloping shelf.

Figure 2:
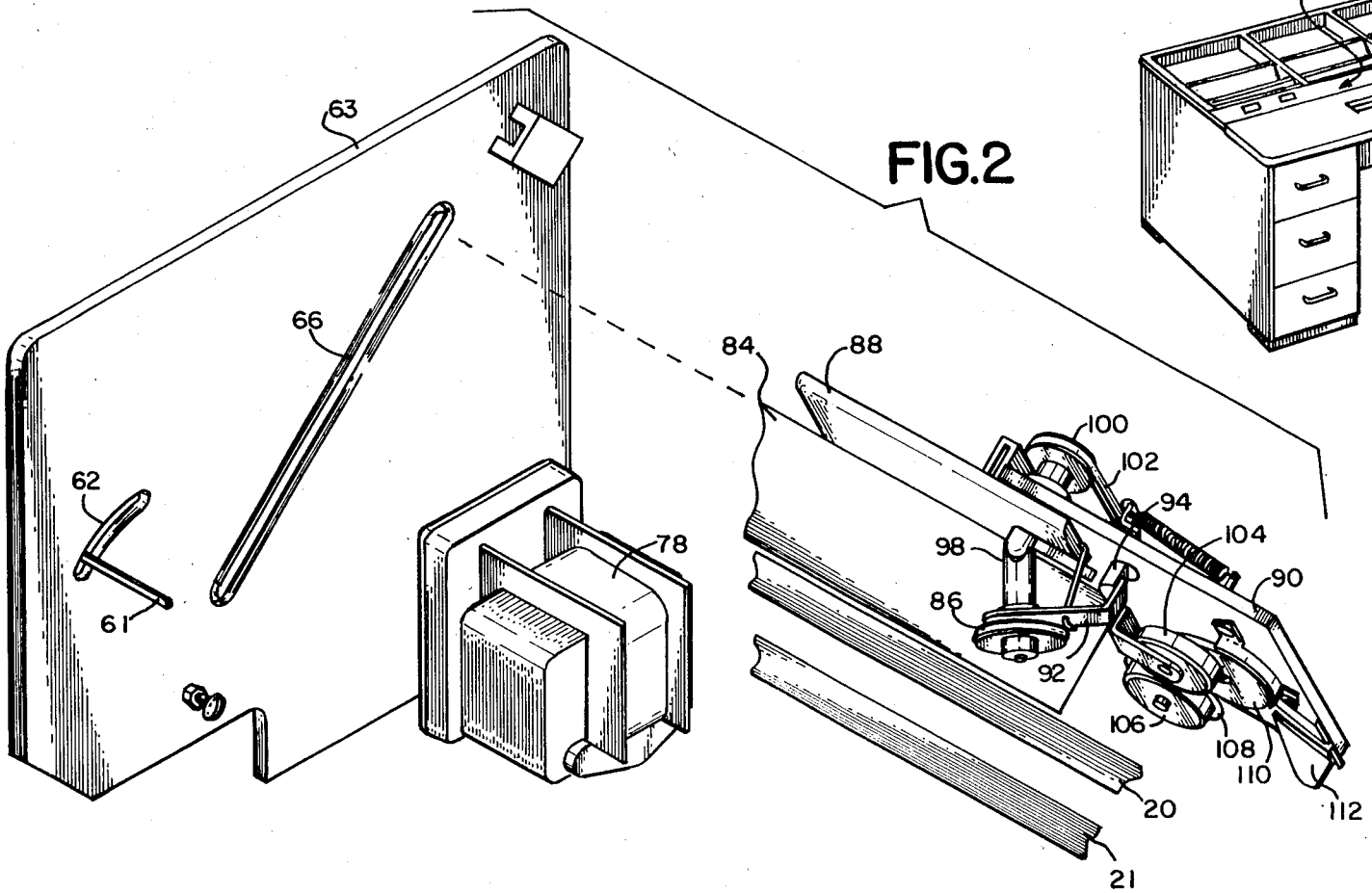
FIG. 2 is a perspective view, taken from the back of the FIG. 1 desk, of the side edge and top edge cutting mechanisms of the present invention.

FIG. 2 shows the side edge cutter at station 54 and the top edge cutter at station 56 viewed from the rear of the desk. As is evident from FIG. 1*a*, in actual practice, the two cutting mechanisms are spaced further apart than as they appear in FIG. 2 and on opposite sides of the point at which the envelopes are supplied from tray 50. However, in order to fit the two mechanisms into a single figure to illustrate their relative positions and orientations, they are shown in closer proximity to one another in FIG. 2.

Figure 3:
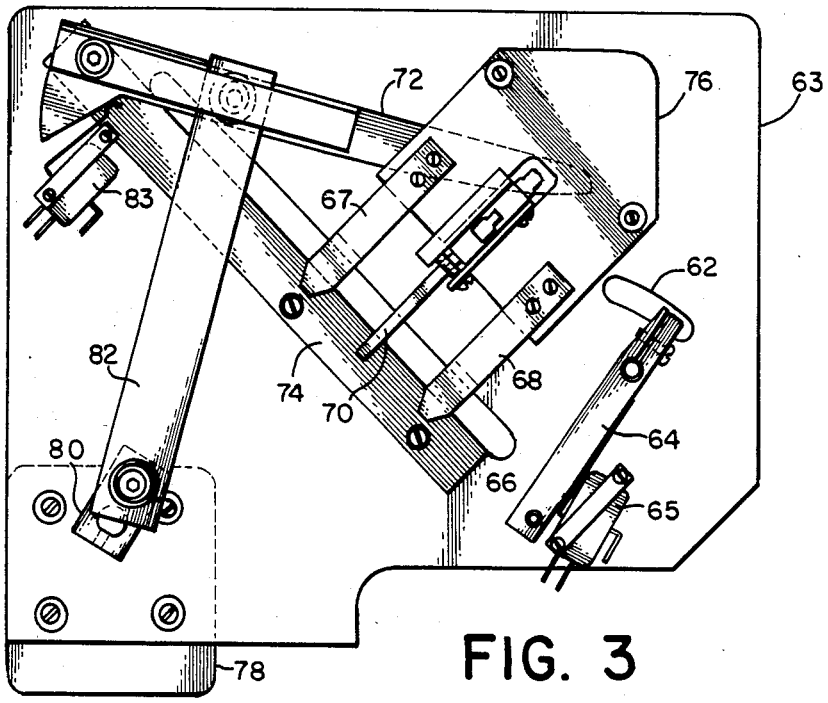
FIG. 3 is an end view of the side edge cutting mechanism of FIG. 2.
Figure 4:
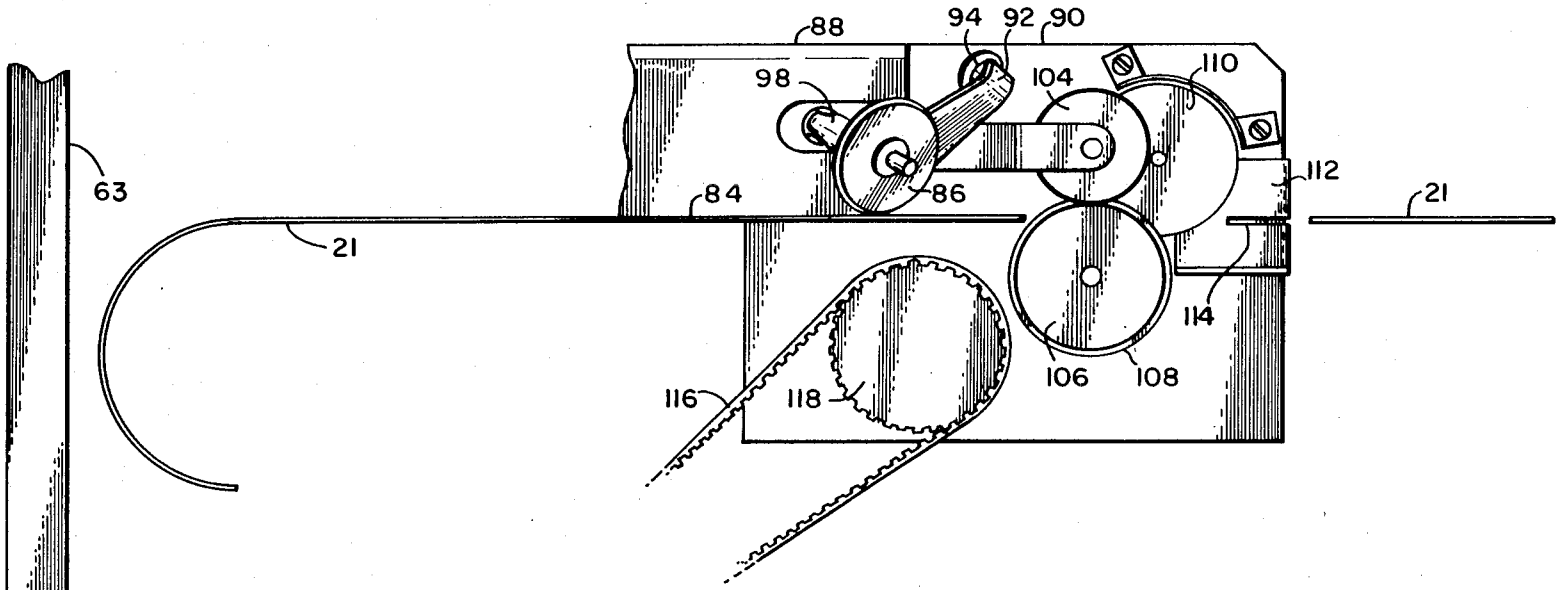
FIG. 4 is a front view of the top edge cutting mechanism of FIG. 2.

Referring to FIGS. 2, 3 and 4, as an envelope moves from the feed tray to the conveyor, the envelope engages a finger 61 which projects through a slot 62 in a mounting plate 63 of the side edge cutter. Finger 61 is carried on a pivot arm 64 which controls the action of a microswitch 65 to close a circuit and move belts 20 and 21 to the left in FIGS. 2 and 4 (to the right in FIG. 1). This causes a side edge of the envelope to pass through a slot 66 in mounting plate 63. As this edge of the envelope passes through slot 66, it abuts against a pair of stop fingers 67 and 68 which limit the movement of the envelope in this direction. The envelope also hits against a microswitch 70 which closes a circuit to drive a moveable shear 72 downward. As shear 72 passes a stationary knife bed 74 upon which the envelope rests, the side edge of the envelope is nipped. Typically, an approximately $\frac{1}{8}''$ wide piece is cut. The desired cut is set by positioning an adjusting plate 76 to which stop fingers 67 and 68 and microswitch 70 are fastened.

Shear 72 is moved by a motor 78 which is actuated by microswitch 70 when the side edge of the envelope hits the microswitch. The output shaft of motor 78 and shear 72 are coupled together by a crank 80 and a connecting rod 82. After the envelope side edge is cut, shear 72 is returned to its initial position to await the next envelope.

The movement of shear 72 controls the action of a microswitch 83 to close a circuit and move belts 20 and 21 to the right in FIGS. 2 and 4 (to the left in FIG. 1) to move the envelope to the top edge cutter. Belts 20 and 21 deliver the envelope to a pick-up plate 84 where the envelope is pinched between a rotating pick-up wheel 86 and the pick-up plate. Pick-up wheel 86, positioned at an angle to the direction of movement of belts 20 and 21, serves to move the envelope into and through the top edge cutter. Specifically, pick-up wheel 86 urges the top edge of the envelope against a plate 88 to align the envelope for cutting the top edge of the envelope as the pick-up wheel moves the envelope through the cutter.

Pick-up wheel 86 preferably has a rubber O-ring periphery which provides the needed friction to pinch the envelope. Pick-up wheel 86 is mounted on a plate 90 by means of a pick-up arm 92 and a clevis 94.

Rotary movement of pick-up wheel 86 is achieved by a universal joint 98 which is coupled to a pulley 100 which, in turn, is driven by a belt 102.

The envelope is picked up by a pair of rubber rollers 104 and 106 between which the envelope is pinched. Roller 106 is driven and roller 104 is an idler. Rollers 104 and 106 draw the envelope away from pick-up plate 84 and feed the envelope to a pair of rotary cutters 108 and 110 disposed parallel to the top edge of the envelope. Cutter 108 and rubber roller 106 are mounted on the same shaft, so that cutter 108 is driven. Cutter 110 is an idler and is mounted on a shaft such that it may move axially on this shaft. This is done to permit cutter 110 to move away from cutter 108 if an object, such as a paper clip, is in the envelope at the top edge which might otherwise damage one or both of the cutters.

It is useful to point out the relative positions of pick-up plate 84, the pinch-point of rubber rollers 104 and 106, and the cutting point of cutters 108 and 110 and to explain the reason for positioning these parts the way they are illustrated. First, as shown most clearly in FIG. 4, the pinch-point between rollers 104 and 106 and the cutting point of cutters 108 and 110 are above the plane of the top surfaces of pick-up plate 84 and belts 20 and 21. This permits the envelope to become airborne after the top edge is cut and before the envelope returns to belts 20 and 21, whereby the envelope can move away from plate 90 and be deposited lower on belts 20 and 21. The importance of this will be explained shortly.

Also as shown most clearly in FIG. 4, the cutting point of cutters 108 and 110 is located very close to the pinch-point of rollers 104 and 106. The close proximity of these two points protects against buckling of the envelope as it is supplied by the rollers to the cutters. Buckling tends to occur if these two points are spaced further apart.

Located at the exit of the top edge cutter is a deflector plate 112 having a slot 114. The top portion of deflector 112 serves to assure a complete straight-line cut of the top edge by preventing rounding of the cut at the trailing edge of the envelope. The bottom portion of deflector plate 112 serves to direct the piece cut by the top edge cutter away for disposal. Slot 114 permits each portion of the deflector plate to be set separately to produce the desired result.

Figure 5:
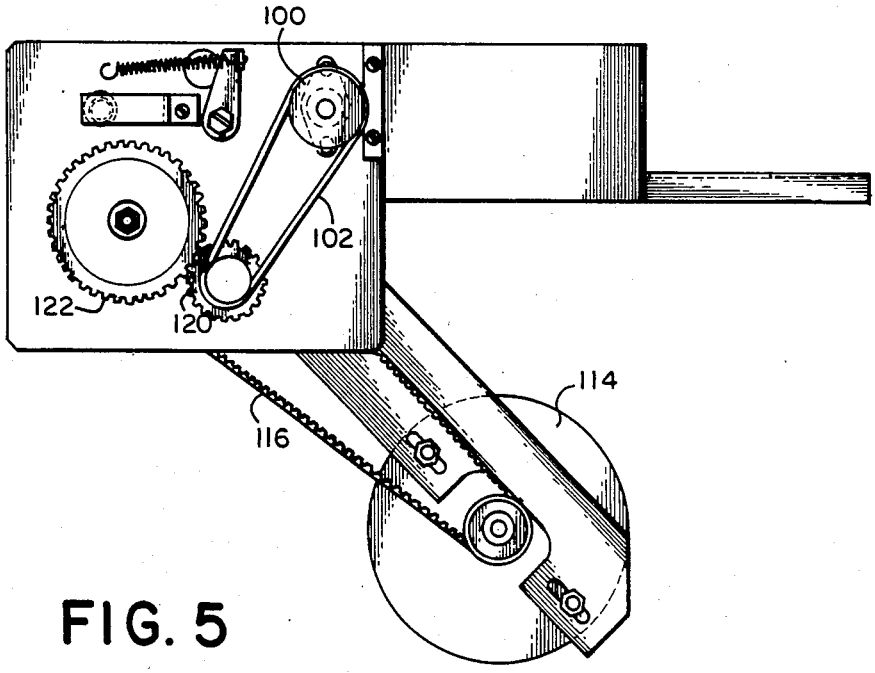
FIG. 5 is a rear view of the top edge cutting mechanism of FIG. 2.

Referring to FIGS. 2, 4 and 5, pick-up wheel 86, roller 106, and cutter 108 are driven by a motor 114. The output of motor 114 drives a belt 116 which turns a gear 118. Another gear 120, positioned on the opposite side of plate 90 from gear 118, is mounted on the same shaft with gear 118 and turns with gear 118 to move belt 102. Belt 102, in turn, drives pulley 100 causing universal joint 98 and pick-up wheel 86 to rotate. Gear 120 also drives a gear 122 which is mounted on the same shaft with roller 106 and rotary cutter 108, thereby causing roller 106 and rotary cutter 108 to rotate.

After the top edge of the envelope is cut, the envelope is moved to the left in FIG. 1 (to the right in FIGS. 2 and 4) by belts 20 and 21 and delivered to station 58 where the envelope contents are extracted. Means are provided for separating the front and back faces of the envelope so that an operator sitting in front of the desk may reach into the spread-open envelope and remove its contents. Again, apparatus of U.S. Pat. No. 4,124,968, namely suction cups 22 and 23, may be used to separate the envelope contents and the disclosure in U.S. Pat. No. 4,124,968 of this mechanism is incorporated by reference herein as if fully set forth.

The suction applied to the envelope to keep it against belts 20 and 21 acts to keep the front and back faces of the envelope in contact with each other and works against the envelope separating suction cups. In order to overcome this effect, the envelope is rendered airborne as it exits from the top edge cutter to permit the envelope to land as low as possible on belts 20 and 21 before the envelope is delivered to the envelope separating suction cups. This positioning of the envelope on belts 20 and 21 presents the envelope to the suction cups such that the front and back faces of the envelope are engaged by the suction cups near their tops. Separation of the faces of the envelope becomes more difficult as the engagement of the suction cups and the envelope is lowered.

U.S. Pat. No. 4,124,968 also discloses means for sensing the removal of the contents of the envelope and for automatically moving the envelope to the next station. That portion of the disclosure of U.S. Pat. No. 4,124,968 directed to such sensing and movement of the envelope also is incorporated by reference herein as if fully set forth.

After the envelope contents have been removed, the envelope is moved to the right in FIGS. 2 and 4 (to the left in FIG. 1) by belts 20 and 21 and delivered to station 60 where is is "candled" to detect the presence of contents which have not been removed from the envelope. Here again, the apparatus of U.S. Pat. No. 4,124,968, namely photocell 30 and light bulb 32, may be used to perform this function and the disclosure in U.S. Pat. No. 4,124,968 of this arrangement is incorporated by reference herein as if fully set forth.

Finally, the empty envelope is carried by belts 20 and 21 toward the left-hand edge of the desk where it is discarded, for example, by being allowed to drop into a waste receptacle housed within the desk.

The foregoing has set forth an exemplary and preferred embodiment of the present invention. It will be understood that various other alternative embodiments will occur to those of ordinary skill in the art without departure from the spirit or scope of the present invention.

What is claimed:

1. An envelope contents extraction system comprising:

means for supplying a plurality of envelopes one-by-one;

means for transporting individual envelopes along a single straight-line path to a plurality of stations;

means located along said path for opening a first edge of each of said envelopes while said first edge is disposed perpendicular to said path;

means located along said path for opening a second edge of each of said envelopes adjacent said first edge while said second edge is disposed along said path;

wherein said supply means delivers said envelopes to said path at a location between said first edge opening means and said second edge opening means;

means located along said path and downstream from said second edge opening means for separating the front and back faces of said envelopes;

and means for controlling movement of said transporting means to move said envelopes along said path, wherein said control means drive said transporting means first in one direction to move each envelope to said first edge opening means and then in an opposite direction to move each envelope to said second edge opening means and said separating means.

2. An envelope contents extraction system according to claim 1 wherein:

said first edge opening means include a cutter for cutting a side edge of each of said envelopes; and said second edge opening means include a cutter for cutting a top edge of each of said envelope.

3. An envelope contents extraction system according to claim 2 wherein said second edge cutter is downstream from said first edge cutter.

4. An envelope contents extraction system according to claim 3 wherein said first edge is the trailing edge of an envelope relative to its movement from said first edge cutter to said second edge cutter.

5. An envelope contents extraction system according to claim 4 wherein said transporting means include:.

a pair of spaced parallel endless belts extendling parallel to said path and against which a face of said envelopes bears; and suction means positioned on the opposite side of said belts from said envelopes for drawing said envelopes against the belts.

6. An envelope contents extraction system according to claim 2 wherein the cutter of said first edge opening means operates generally transverse to the side edge of said envelopes, and wherein the cutter of said second edge opening means operates generally longitudinally along the top edge of said envelopes.

7. An envelope contents extraction system comprising:

means for supplying a plurality of envelopes one-by-one;

a side edge cutter, a top edge cutter, and an envelope spreader all positioned along a single straight-line with said side edge cutter located on one side of said envelope supply means and said top edge cutter and said envelope spreader located on the opposite side of said envelope supply means;

a conveyor for transporting said envelopes to said side edge cutter, said top edge cutter and said envelope spreader;

and control means for imparting reversible movement to said conveyor to first move said envelopes in one direction to said side edge cutter, and to then move said envelopes in an opposite direction through said top edge cutter and to said envelope spreader.

8. An envelope contents extraction system according to claim 7 wherein said side edge cutter is located beyond one end of said conveyor.

9. An envelope contents extraction system according to claim 8 wherein said side edge cutter includes a reciprocating knife which moves transverse to said straight-line and said top edge cutter includes a pair of rotary cutters disposed along said straight-line.

10. An envelope contents extraction system according to claim 7 further including candling means downstream from said envelope spreader for indicating the presence of contents in said envelopes.

* * * * *